US006083114A

United States Patent [19]

Bailey

[11] Patent Number: 6,083,114

[45] Date of Patent: Jul. 4, 2000

[54] UMBRELLA/GOLF TARGETING APPARATUS

[76] Inventor: James P. Bailey, 1538 S. Foothill, Salt Lake City, Utah 84108

[21] Appl. No.: 09/128,214

[22] Filed: Aug. 3, 1998

Related U.S. Application Data

[60] Provisional application No. 60/054,711, Aug. 4, 1997.

[51] Int. Cl.[7] ..... A63B 69/36

[52] U.S. Cl. ..... 473/196; 473/162; 473/172

[58] Field of Search ..... 473/173, 172, 473/190, 196, 162, 150; 213/181 A

[56] References Cited

U.S. PATENT DOCUMENTS

| | | | |
|---|---|---|---|
| 4,281,834 | 8/1981 | Chavez | 273/182 |
| 4,358,116 | 11/1982 | Florida | 273/177 |
| 4,407,505 | 10/1983 | Kendziorszki | 273/177 |
| 4,542,757 | 9/1985 | Phillips | 135/16 |
| 4,711,260 | 12/1987 | Wiens et al. | 135/16 |
| 5,383,667 | 1/1995 | Sheely | 273/181 |
| 5,397,130 | 3/1995 | Brown | 273/348 |
| 5,411,265 | 5/1995 | Falco | 273/181 |
| 5,441,267 | 8/1995 | Alder | 273/177 |
| 5,830,076 | 11/1998 | Borys | 473/173 |

FOREIGN PATENT DOCUMENTS

| | | | |
|---|---|---|---|
| 785654 | 5/1905 | Canada | 273/181 A |

*Primary Examiner*—Mark S. Graham
*Attorney, Agent, or Firm*—Madson & Metcalf

[57] ABSTRACT

An apparatus for collecting golf balls comprising a collection assembly having a canopy and a collection net selectively movable between an open position and a collapsed position. In design, the canopy is formed of a durable material having an outer radial portion engaging the distal ends of a plurality of support ribs. Similarly, the collection net has an outer radial portion engaging the distal ends of said support ribs such that the collection net is generally suspended in relation to an interior surface of the canopy. The collection net is preferably formed of a sufficiently durable material capable of absorbing the impact of at least one projectile (e.g., golf ball) and distributing the impact force of the projectile through at least a section of the body of the collection net. An elongated shaft supportably engages the plurality of support ribs, thereby supporting the collection assembly. Operatively moveable in relation to the elongated shaft is an actuating assembly for selectively positioning the collection assembly between the open and collapsed positions. To support the collection assembly in the open position relative to an underlying surface, a support member is attached at the first end of the elongated shaft. A flag is also provided to serve as a visual target to a user when chipping and/or pitching into the collection assembly of the present invention.

15 Claims, 4 Drawing Sheets

UMBRELLA/GOLF TARGETING APPARATUS

RELATED APPLICATION

This application claims the benefit of U.S. Provisional Application, Ser. No. 60/054,711, filed on Aug. 4, 1997 for UMBRELLA GREEN.

BACKGROUND

1. The Field of the Invention

This invention relates to practice aid devices used when training for recreational sporting activities and, more particularly, to novel apparatus providing a lightweight and portable three-dimensional target area for receiving and collecting golf balls during chipping and pitching practice.

2. The Background Art

Golf is one of the most popular recreational and competitive sports in the world and its popularity is on the increase. The game of golf, however, is one of the most difficult games to master without investing many hours of practice.

As will be appreciated, a golf course generally has nine or eighteen holes spread over a landscaped area of fairways and greens that typically includes a number of hazards such as water, rough, sand traps, and/or trees that are designed to make the game more difficult. Difficulty is also increased by the varying distances among holes. At the end of each hole, which can vary in length from about 135 meters to 550 meters (150 yards to 600 yards), is the putting green, which surrounds the actual hole into which the ball must be putted in order to complete the hole.

Each participant uses a variety of clubs to drive a small ball into a succession of designated holes, over a course of obstacles, in as few strokes as possible. To this end, low golf scores are often attributed to a good short game. An essential part of the short game involves chipping the ball short distances in order to position the ball near the hole for putting. However, many people do not practice their short game because it can be relatively tedious.

Since the game of golf continues to attract an increasing number of players, various types of instructional aids and practice devices have been developed to assist golfers in improving their technique and level of skill. For example, those skilled in the art developed golf practice devices comprising a length of rigid cylindrical tubing in the form of a loop that is supported by at least three support legs connected to the loop. The support legs provide positioning of the tubing above the ground to thereby define a practice area within the clearance portion of the legs and the outside diameter of the circle of tubing.

Similarly, those skilled in the art developed ball targeting devices characterized by being made up of an open frame having a generally circular, outer peripheral support rim which is adjustably mounted in a raised, horizontal position above the ground surface by circumferentially spaced adjustable leg members. A target in the form of a solid panel or sheet is inset or positioned in a plane beneath the upper edge of the support rim and fastened thereto, thereby offering very much the same playing surface as the ground surface so that when a ball strikes the panel the golfer can ascertain by the speed and distance of roll across the panel whether the ball has been properly struck. For convenience, a pair of ball return conduits are positioned in spaced relation to one another in the panel disposed in relation to the support panel.

Another prior art targeting device developed by those skilled in the art involves the use of an inverted umbrella canopy that serve as a backstop for stopping or interrupting the flight of low trajectory golf balls. This inverted umbrella canopy device includes pockets which act as both targets and collection receptacles for golf balls. In order for a golf ball to be received and retained within one of the pockets, the ball must be hit with such precision so as to introduce the ball within the collection pocket, otherwise the ball is deflected by the inverted canopy acting as a backstop, thereby producing a "rebound" effect relative to the direction, angle, and force of impact of the ball against the backstop thus providing a variety of directional rebound possibilities.

As can be appreciated, the inability to determine potential rebound possibilities of an incoming projectile invokes safety ramifications in relation to potential injuries which may be sustained by a user or others in the vicinity of the inverted umbrella backstop. Another significant disadvantage of such prior art targeting/backstop golf practice devices is that the inverted canopy which is disposed at an angle to the ground does not collect and retain a majority of the golf balls that are hit into its internal periphery. Furthermore, because the targeting pockets in the backstop are positioned above ground-level and disposed at an angle relative to the ground such that a ball would have to travel in a different trajectory than would be generally taken by a golf ball targeted to a hole on the green, these prior art targeting devices do not realistically simulate chipping into a hole on the golf course.

In an attempt to improve the portability and placement of prior art golf practice devices, those skilled in the art developed a golf chipping target comprised of a body having a disc-shaped upper surface and a circumferential portion surrounding the upper surface which provides a gradual slope and extends downwardly from the upper surface. The bottom of the circumferential portion defines a circular opening for receiving a golf ball in netting loosely secured beneath the rim of the opening, thereby providing means for entrapping a ball entering the hole. The golf chipping target device is adapted so that it glides or flies a substantial distance when thrown through the air and lands in an upright position on the ground upon impact. A disadvantage to these prior art golf chipping targets, however, is that the opening formed in the disc-shaped base unit comprises a restricted internal surface area such that only a single golf ball is capable of fitting dimensionally within the opening.

Consistent with the foregoing, while golf practice and targeting devices of the prior art may appear generally suitable for their intended purposes, they nevertheless leave much to be desired from the standpoint of effectiveness of operation and protecting a user or others from potential injuries sustained from rebounding golf balls. In this regard, the present invention provides for novel apparatus providing a lightweight and portable three-dimensional target area for receiving and collecting golf balls during chipping and/or pitching practice which overcomes several deficiencies of prior art golf practice and targeting devices and resolves several problems left unsolved by the known prior art.

It will be appreciated that it would be an advancement in the art to provide an apparatus for efficiently receiving and collecting golf balls so that chipping and/or pitching performance of a user can be quantified. It would be a further advancement to provide such a device that has a flag serving as a target and a collection assembly that collects golf balls having a trajectory similar to that taken by a golf ball targeted for a hole on the green of a golf course. Finally, it would be an advancement in the art to provide a golf collection device with the foregoing features that facilitates the functionality of an umbrella and which is easy to assemble and disassemble, efficient in operation, and portable for carrying on the golf course.

BRIEF SUMMARY AND OBJECTS OF THE INVENTION

In view of the foregoing, it is a primary object of the present invention to provide a novel apparatus for collecting golf balls which provides an effective means for receiving and collecting balls during chipping or pitching practice.

Consistent with the foregoing object, and in accordance with the invention as embodied and broadly described herein, an apparatus for collecting golf balls is disclosed in one presently preferred embodiment of the present invention as including a collection assembly comprising a canopy and a collection net. In preferred design, the canopy is formed of a durable material having an outer radial portion that engages the distal ends of a plurality of support ribs. Similarly, the collection net comprises an outer radial portion engaging the support ribs such that the collection net is generally suspended in relation to an interior surface of the canopy. The collection net is preferably formed of a sufficiently durable material capable of absorbing the impact of at least one projectile (e.g., golf ball) and distributing the impact force of the projectile through at least a section of the body of the collection net. Similarly, the material comprising the collection net consists of a mesh lattice having a dimensional size sufficient for preventing the passing of the projectile therethrough.

Simulating an umbrella configuration in preferred construction, the collection assembly is capable of being selectively movable between an open position and a collapsed position. In one presently preferred embodiment, a locking mechanism is provided to lock the collection assembly in the open position, if desired. Structurally, the collection assembly is disposed in relation to an elongated shaft having a first end and a second opposing end, wherein the proximal ends of the support ribs are pivotally attached at the first end of the shaft.

In one presently preferred embodiment of the present invention, the elongated shaft is extendible. In particular, the extendible shaft may comprise one or more shaft extension members having a dimensional periphery adapted for removable engagement with the second end of the elongated shaft. The extension member may be secured to the elongated shaft by means of a frictional engagement wherein the shaft extension members either fit within or over the second end of the shaft. Alternatively, the shaft may be extended by means of one or more retractable shaft extensions. These retractable shaft extensions are preferably designed such that they are capable of being securely retracted within the internal periphery of the body of the elongated shaft and, in the alternative, extended substantially outward from the second end of the elongated shaft.

An actuating assembly is preferably disposed about and moveable in relation to the elongated shaft. In operation, the actuating assembly selectively positions the collection assembly between an open position and a collapsed position. In design, the actuating assembly may comprise an actuating sleeve and a plurality of actuating struts The actuating sleeve is concentrically disposed about and movable with respect to the elongated shaft. Preferably, the actuating struts having a first end pivotally attached between the proximal and distal ends of the support ribs and a second end pivotally attached to the actuating sleeve such that the movement of the actuating sleeve along the body of the elongated shaft moves the collection assembly between the collapsed position and the open position.

The apparatus for collecting golf balls of the present invention further provides a support member attached at the first end of the elongated shaft. In one presently preferred embodiment, the support member projects substantially outward from the first end of the elongated shaft to provide means for supportably securing the collection assembly to the ground. When the collection assembly is operatively disposed in the open position, a user may chip or pitch a golf ball into the internal periphery of the collection net suspended in relation to the canopy. The support member, preferably detachable from the first end of the elongated shaft, may include a spike or at least two support legs.

In addition to the foregoing, the apparatus for collecting golf balls of the present invention comprises a flag attached to the elongated shaft which serves as a visual target to a user. Alternatively, the flag may be used to provide means for securing the collection assembly in the collapsed position for storage.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings, in which:

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the systems and methods of the present invention, as represented in FIGS. 1 through 4B, is not intended to limit the scope of the invention, as claimed, but it is merely representative of the present preferred embodiments of the invention.

The present preferred embodiments of the invention will be best understood by reference to the drawings, wherein like parts are designated by like numerals throughout.

Figure 1:
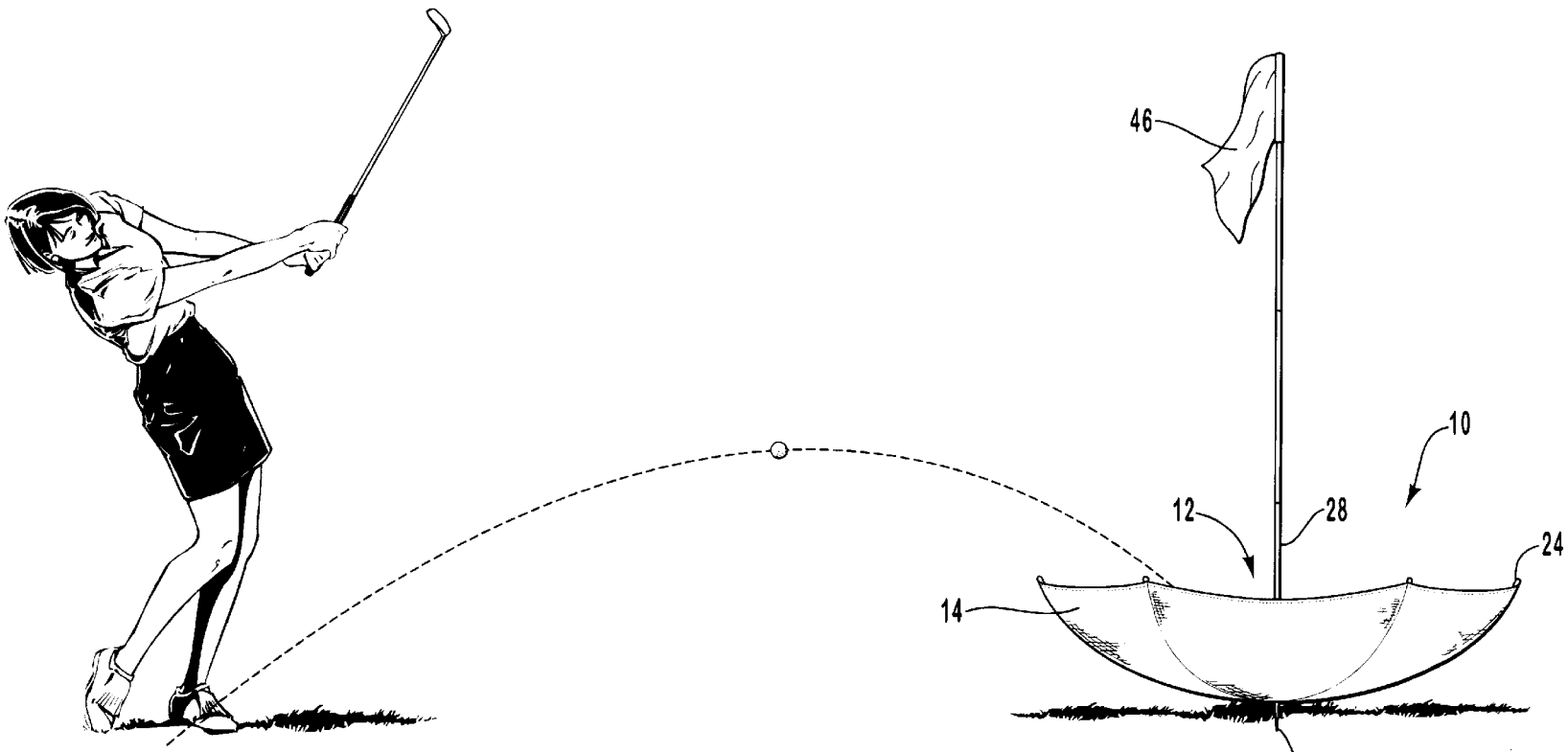
FIG. 1 is a perspective view of an apparatus for collecting golf balls in accordance with one presently preferred embodiment of the present invention.
Figure 2:
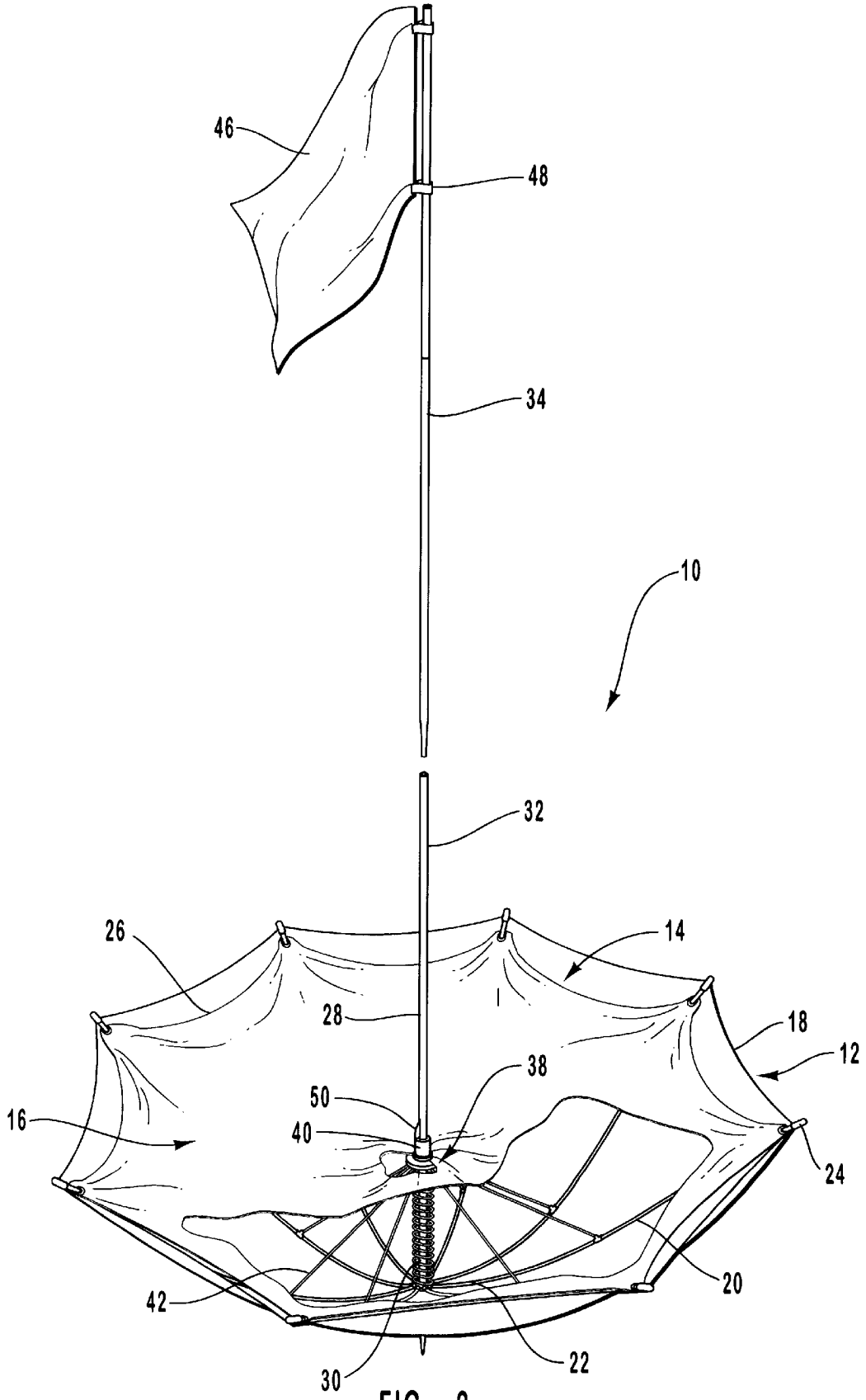
FIG. 2 is a partial cut-away top end view of one presently preferred embodiment of the apparatus for collecting golf balls as shown in FIG. 1, wherein the collection assembly is disposed in an open position.

One presently preferred embodiment of the present invention, designated generally at 10, is best illustrated in FIGS. 1 and 2. As shown, the apparatus for collecting golf balls 10 is preferably formed including an elongated shaft 28, an actuating assembly 38, and a collection assembly 12 comprising a canopy 14, a collection net 16, and support ribs 20. Structurally, the support ribs 20 support the canopy 14 and the collection net 16 in a playable position when the collection assembly 12 is disposed in an open position. The actuating assembly 38 provides means for selectively supporting the canopy 14 and the collection net 16 of the collection assembly 12 between the open position and a collapsed position. In addition, a locking mechanism 50 may be provided to supportably lock the collection assembly 12 in the open playable position, as shown in FIGS. 1 and 2.

In preferred design, the canopy 14 consists of a durable material having an inner portion that is fixed contiguous the first end 30 of the elongated shaft 28 and an outer radial portion 18 that engages the distal ends 24 of the plurality of support ribs 20, thereby simulating the configuration of an umbrella. In one presently preferred embodiment of the present invention, the material comprising the canopy 14 is substantially waterproof. In this regard, when the collection assembly 12 is disposed in the open position, the canopy 14 can be used as a conventional umbrella.

Referring now to FIG. 2, the collection net 16 of the collection assembly 12 is formed having an inner portion that is preferably attached to the actuating assembly 38 and an outer radial portion 26 attached to the distal end 24 of each of the support ribs 20. In the open position, the collection assembly 12 is capable of collecting golf balls that are chipped and/or pitched into the internal periphery defined by the canopy 14 and the collection net 16 which is operatively suspended in relation to the canopy.

The collection net 16 is preferably formed of a sufficiently durable material capable of absorbing the impact of at least one projectile (e.g., golf ball) and distributing the impact force of the projectile through at least a section of the body of the collection net 16. For example, the collection net 16 may consist of a material comprising a mesh lattice having a dimensional size and shape sufficient for preventing the projectile from passing therethrough and damaging the internal components of the present invention.

The support ribs 20 are composed of a material sufficiently flexible and resilient to withstand bowing without permanent deformation, but rigid enough to support the canopy 14 and the collection net 16 in the open position In one presently preferred embodiment of the present invention, the support ribs 20 are formed of a lightweight aluminum. It will be readily appreciated, however, that other suitable materials are possible. For example, the support ribs 20 may be formed of other metals, fiberglass, graphite, ceramic, any of numerous organic, synthetic, or processed materials that are mostly thermoplastic or thermosetting polymers of high molecular weight, or any other suitable polymeric or composite material consistent with the spirit and scope of the present invention.

Figure 3:
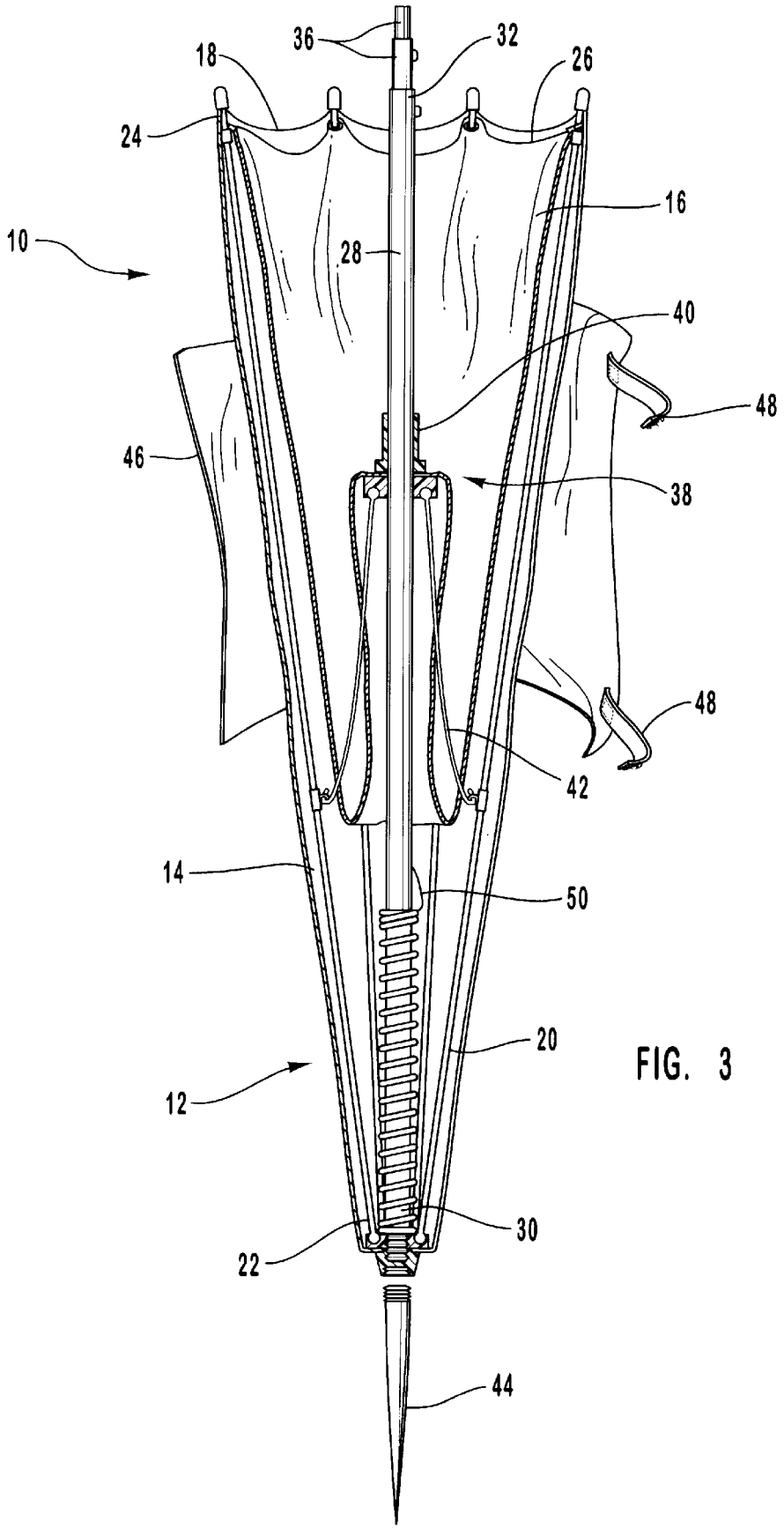
FIG. 3 is a cross-sectional view of one presently preferred embodiment of the apparatus for collecting golf balls as shown in FIG. 1.

As best illustrated in FIGS. 2 and 3, the collection assembly 12 is operatively disposed in relation to the elongated shaft 28. The elongated shaft 28 is formed having a first end 30 and a second opposing end 32, wherein the proximal ends 22 of the support ribs 20 are pivotally attached at the first end 30 of the elongated shaft 28. The elongated shaft 28 is preferably formed of a sufficiently rigid material sufficient for supporting the collection assembly 12 and actuating assembly 38 in relation thereto. In one presently preferred embodiment of the present invention, the elongated shaft 28 is formed of aluminum. It will be readily appreciated, however, that other suitable materials are possible. For example, the elongated shaft 28 may be formed of other metals, fiberglass, graphite, ceramic, any of numerous organic, synthetic, or processed materials that are mostly thermoplastic or thermosetting polymers of high molecular weight, or any other suitable polymeric or composite material consistent with the spirit and scope of the present invention.

Figure 4A:
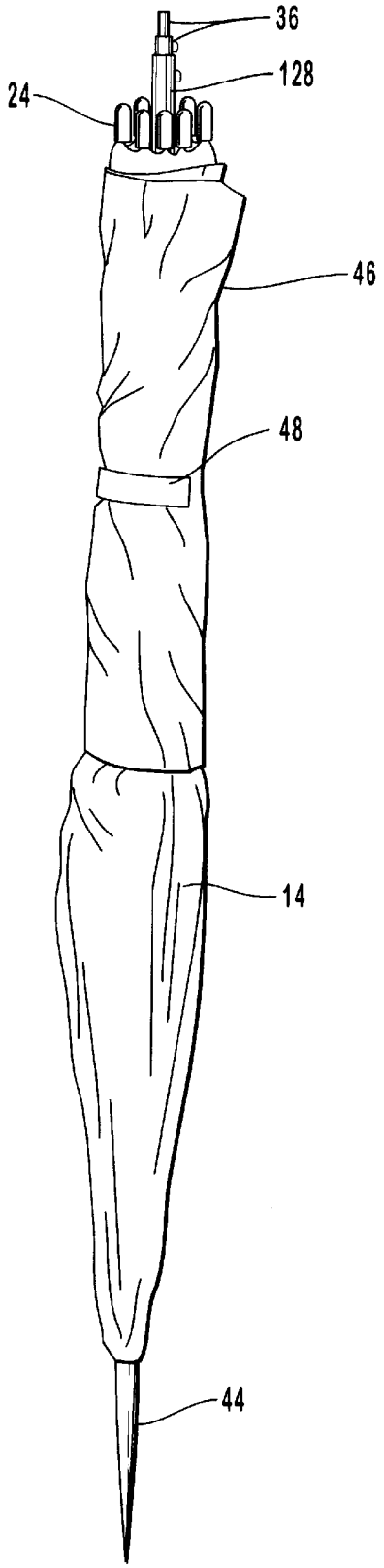
FIG. 4A is a side view of one presently preferred embodiment of the apparatus for collecting golf balls which illustrates the collection assembly secured in a collapsed position with the flag engageably disposed around the canopy and the retractable shaft extensions being retracted within the internal periphery of an elongated shaft.
Figure 4B:
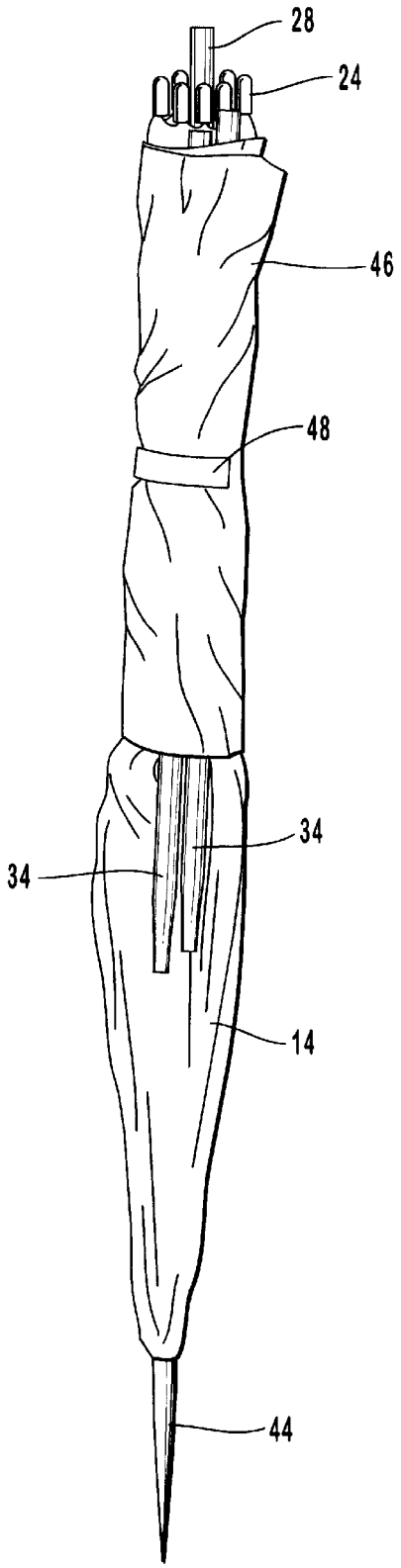
FIG. 4B is a side view of yet another presently preferred embodiment of the apparatus for collecting golf balls which illustrates the collection assembly secured in the collapsed position and the shaft extensions being detached from their engagement with the elongated shaft and maintained in selective relationship to the canopy by the flag engageably disposed around both the shaft extensions and the canopy.

Referring to FIGS. 1 and 4B, in one presently preferred embodiment of the present invention, the shaft 28 is extendible in its longitudinal length. In preferred design, the extendible shaft 28 comprises one or more shaft extension members 34 having a dimensional periphery adapted for removable engagement with the second end 32 of the shaft 28. Each of the shaft extension members 34 may be secured to the elongated shaft 28 by means of a frictional engagement such that the shaft extension members 34 either fit within or over the outer periphery of the body of the elongated shaft 28.

Alternatively, the elongated shaft 128 may be extended by means of one or more retractable shaft extensions 36, as shown in FIGS. 3 and 4A. These retractable shaft extensions 36 are preferably designed such that they are capable of being securely retracted within the internal periphery of the body of the elongated shaft 128 and, in the alternative, extended substantially outward from the second end 32 of the elongated shaft 128. It will be readily appreciated by those skilled in the art, however, that other mechanisms may be constructed in accordance with the inventive principles set forth herein and are hereby incorporated herein by reference those mechanisms that are consistent with the sprit and scope of the present invention.

With particular reference to FIGS. 2 and 3, the canopy 14 and collection net 16 of the collection assembly 12 are movable between the open position and the collapsed position by means of actuating an actuating assembly 38. In one presently preferred embodiment of the present invention, the actuating assembly 38 comprises an actuating sleeve 40 and a plurality of actuating struts 42. The actuating sleeve 40 is preferably positioned concentrically about the elongated shaft 28 and is selectively movable with respect to the elongated body of the shaft 28. The slidable movement of the actuating sleeve 40 along the elongated shaft 28 facilitates the pivotally attached actuating struts 42 to actuate the support ribs 20 such that the support ribs 20 spread radially and encourage the canopy 14 and collection net 16 into an open position. As discussed above, the actuating sleeve 40 may be secured near the first end 30 of the elongated shaft 28 by a locking mechanism 50 that selectively locks the canopy 14 and the collection net 16 in the open playable position.

In one presently preferred embodiment, the locking mechanism 50 comprises a spring-biased tab positioned near the first end 30 of the elongated shaft 28. The actuating sleeve 40 may be moved along the body of the elongated shaft 28 toward the first end 30 of the shaft 28 until the actualization sleeve 40 extends past the spring-biased tab 50, thereby securing the canopy 14 and the collection net 16 of the collection assembly 12 in the open playable position. To collapse the canopy 14 and the collection net 16, a user may manually apply pressure to the spring-biased tab 50, releasing the actuating sleeve 40 and thereby allowing the actuating sleeve 40 to be moved along the shaft 28 toward the second end 32, thus returning the canopy 14 and the collection net 15 to the collapsed position.

It will be apparent that other mechanisms may be constructed in accordance with the inventive principles set forth herein. For example, other means for actuating the collection assembly 12 between the open and collapsed positions, for locking the collection assembly 12 into the open position, and for extending the length of the elongated shaft are possible. It is intended, therefore, that the examples provided herein be viewed as exemplary of the principles of the present invention, and not as restrictive to a particular structure for implementing those principles.

A support member 44 is preferably attached at the first end 30 of the elongated shaft 28, 128 as shown in FIGS. 3, 4A and 4B. Functionally, the support member 44 provides means for supporting the collection assembly 12 in the open position relative to the support surface. In one presently preferred embodiment, the support member 44 comprises a proximal end which engages the first end 30 of the elongated shaft 28, 128 and a distal end having a tapered body and a sharp tip sufficient for piercing the underlying support surface. For example, the support member 44 may include a spike, wherein the spike may be selectively detachable from the first end 30 of the shaft 28, 128.

For outdoor use of the apparatus for collecting golf balls 10 of the present invention, the spike 44 may engage the first end 30 of the elongated shaft 28, 128 and thereafter be inserted into the ground. Correspondingly, the spike 44 should be of sufficient length and diameter and comprised of a sufficiently rigid material (e.g., steel, iron, aluminum, or other suitable polymeric or composite material) such that the collection assembly 12 is capable of receiving and retaining projectiles when the canopy 14 and the collection net 16 are disposed in the open position. As will be appreciated, the apparatus for collecting golf balls 10 may be used indoors with the use of an alternative support member 44, such as one or more support legs (not shown) providing a substantially flat engaging surface.

As best illustrated in FIGS. 1 and 2, a flag 46 may be attached to the elongated shaft 28, 128 to serve as a target for a user of the present invention when chipping and/or pitching. In one presently preferred embodiment, the flag 46 is removably attached to the elongated shaft 28, 128, the shaft extension member 34, or the retractable shaft extension 36. The flag 46 may be formed of a fabric or durable polymeric or composite material sufficient to providing means for binding the collection assembly 12 in the collapsed position.

In addition to providing a means for targeting the apparatus for collecting golf balls 10 of the present invention, as best shown in FIGS. 4A and 4B, the detachable flag 46 may be formed having a dimensional size and shape capable of securing the canopy 14 of the collection assembly 12 in the collapsed position by being wrapped and secured around the outer periphery of the canopy 14 using a fixation member 48 (e.g., hook and loop fasteners, straps, snaps, etc.).

Although the canopy 14 and collection net 16 of the collection assembly 12 of one presently preferred embodiment of the apparatus for collecting golf balls 10 is illustrated and described in connection with a general circular configuration, those skilled in the art will recognize that various other geometrical configurations are possible which are consistent with the spirit and scope of the present invention. Correspondingly, the size, shape, and/or configuration of the collection assembly 12 may vary in accordance with its designed use or need as considered to be herein contemplated. The use of a general circular configuration having the dimensions disclosed herein is thus by way of illustration and not by way of limitation or restriction.

From the above discussion, it will be appreciated that the present invention provides novel apparatus for collecting golf balls which overcomes many of the limitations of the existing prior art practice and targeting devices. Moreover, the present invention provides an apparatus for collecting golf balls that enables golfers to enjoyably practice their chipping and/or pitching.

Based on its novel construction, the present invention provides means for efficiently capturing golf balls, allowing the user to quantify the number of shots made, thereby permitting the user to track his/her progress. Consequently, the present invention simulates chipping and pitching practice similar to a real golf game. Finally, the present invention is easy to transport and carry on the golf course. Therefore, the present invention represents an advancement in the art of devices for aiding golf practice.

Consistent with the foregoing, the present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. An apparatus for collecting golf balls said apparatus comprising:

a collection assembly comprising a canopy having an internal periphery and a collection net, said canopy having an outer radial portion attached to a plurality of support ribs, each of said support ribs comprising a proximal end and a distal end, said collection assembly being selectively movable between an open position and a collapsed position;

said collection net having an outer radial portion securely fixed at said distal ends of said support ribs such that the collection net is generally suspended in relation to said canopy, the collection net being supported throughout its length and comprising a target area adapted to extend over said internal periphery defined by the canopy;

an elongated shaft having a first end and a second opposing end, said proximal ends of said support ribs being pivotally attached to said first end of said elongated shaft;

an actuating assembly for selectively supporting said collection assembly between said open position and said collapsed position, said actuating assembly being disposed about and selectively moveable in relation to said elongated shaft;

a support member attached at said first end of said elongated shaft such that said support member projects substantially outward front the first end of the shaft; and a flag attached to said elongated shaft, wherein said flag provides means for securing said collection assembly in said collapsed position.

2. The apparatus for collecting golf balls as defined in claim 1 further comprising a locking mechanism for locking said collection assembly in said open position.

3. The apparatus for collecting golfballs as defined in claim 1 wherein said collection net is formed of a sufficiently durable material capable of absorbing the impact of at least one projectile and distributing the impact force of said projectile through at least a section of the collection netting, said material comprising a mesh lattice having a dimensional size sufficient for preventing said projectile from passing therethrough.

4. The apparatus for collecting golf balls as defined in claim 1 wherein said elongated shaft is extendible.

5. The apparatus for collecting golf balls as defined in claim 4 wherein said elongated shaft comprises at least one shaft extension member, said shaft extension member having a dimensional periphery adapted for selective engagement in relation to the elongated shaft.

6. The apparatus for collecting golfballs as defined in claim 1 wherein said actuating assembly comprises an actuating sleeve and a plurality of actuating struts, said actuating sleeve disposed about and being selectively movable with respect to said elongated shaft, said actuating struts having a first end pivotally attached between said proximal and distal ends of said support ribs and a second end pivotally attached to the actuating sleeve such that the movement of the actuating sleeve along the elongated shaft positions said collection assembly between said collapsed position and said open position.

7. The apparatus for collecting golfballs as defined in claim 1 wherein said support member comprises a spike.

8. An apparatus for collecting golf balls, said apparatus comprising:

a collection assembly comprising a canopy and a collection net, said canopy having an outer radial portion attached to a plurality of support ribs, each of said support ribs including a proximal end and a distal end, said collection assembly being selectively movable between an open position and a collapsed position;

said collection net having an outer radial portion attached at said distal ends of said support ribs such that the collection net is generally suspended in relation to said canopy;

an elongated shaft having a first end and a second opposing end, said proximal ends of said support ribs being pivotally attached at said first end of said elongated shaft;

an actuating assembly for selectively supporting said collection assembly between said open position and said collapsed position, said actuating assembly being disposed about and selectively moveable in relation to said elongated shaft; and a flag disposed in relation to said elongated shaft, wherein said flag provides means for securing said collection assembly in said collapsed position.

9. The apparatus for collecting golf balls as defined in claim 8 further comprising a support member attached at said first end of said elongated shaft such that said support member projects substantially outward from the first end of the shaft.

10. The apparatus for collecting golf balls as defined in claim 9 wherein said support member comprises a spike.

11. The apparatus for collecting golf balls as defined in claim 8 further comprising a locking mechanism for locking said collection assembly in said open position.

12. The apparatus for collecting golfballs as defined in claim 8 wherein said collection net is formed of a sufficiently durable material capable of absorbing the impact of at least one projectile and distributing the impact force of said projectile through at least a section of the collection netting.

13. The apparatus for collecting golf balls as defined in claim 12 wherein said material comprising said collection net consists of a mesh lattice having a dimensional size sufficient for preventing said projectile from passing therethrough.

14. The apparatus for collecting golf balls as defined in claim 8 wherein said elongated shaft is extendible.

15. The apparatus for collecting golf balls as defined in claim 8 wherein said actuating assembly comprises an actuating sleeve and a plurality of actuating struts, said actuating sleeve disposed about and being selectively movable with respect to said elongated shaft, said actuating struts having a first end pivotally attached between said proximal and distal ends of said support ribs and a second end pivotally attached to the actuating sleeve such that the movement of the actuating sleeve along the elongated shaft positions said collection assembly between said collapsed position and said open position.

* * * * *